US012607417B2

(12) United States Patent
Park et al.

(10) Patent No.: US 12,607,417 B2
(45) Date of Patent: Apr. 21, 2026

(54) HEAT EXCHANGER AND AIR CONDITIONER HAVING SAME

(71) Applicant: SAMSUNG ELECTRONICS CO., LTD., Suwon-si (KR)

(72) Inventors: Sangjun Park, Suwon-si (KR); Sungtae Park, Suwon-si (KR); Kookjeong Seo, Suwon-si (KR); Jungsoo Lim, Suwon-si (KR); Won Ju, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 285 days.

(21) Appl. No.: 18/226,631

(22) Filed: Jul. 26, 2023

(65) Prior Publication Data

US 2023/0366638 A1 Nov. 16, 2023

Related U.S. Application Data

(63) Continuation of application No. PCT/KR2022/003746, filed on Mar. 17, 2022.

(30) Foreign Application Priority Data

Mar. 18, 2021 (KR) ..... 10-2021-0035262

(51) Int. Cl.
*F28F 1/12* (2006.01)
*C22C 21/08* (2006.01)
(Continued)

(52) U.S. Cl.
CPC ..... *F28F 1/12* (2013.01); *C22C 21/08* (2013.01); *F28F 21/084* (2013.01); *F28D 1/05366* (2013.01); *F28F 2275/04* (2013.01)

(58) Field of Classification Search
None
See application file for complete search history.

(56) References Cited

U.S. PATENT DOCUMENTS 9,433,996 B2 9/2016 Wintersteen et al.
10,309,001 B2 6/2019 Okaniwa et al.
(Continued)

FOREIGN PATENT DOCUMENTS

EP 2447662 B1 12/2018
JP 3134329 B2 2/2001
(Continued)

OTHER PUBLICATIONS

Written Opinion (PCT/ISA/237) issued Jul. 7, 2022 from the International Searching Authority in International Application No. PCT/KR2022/003746.
(Continued)

*Primary Examiner* — Daniel J. Schleis
(74) *Attorney, Agent, or Firm* — Sughrue Mion, PLLC

(57) ABSTRACT

A heat exchanger includes a plurality of tubes in which a refrigerant flows, heat-exchanger fins provided between the plurality of tubes, and a filler coupling the heat-exchanger fins to the plurality of tubes, wherein each of the plurality of tubes comprises a first aluminum alloy, each of the heat-exchanger fins comprises a second aluminum alloy, the filler comprises a third aluminum alloy, the plurality of tubes have a corrosion potential of −745 mV to −695 mV, the filler has a corrosion potential of −810 mV to −720 mV, and the heat-exchanger fins have a corrosion potential of −810 mV to −740 mV.

15 Claims, 9 Drawing Sheets

(51) Int. Cl.
*F28F 21/08* (2006.01)
*F28D 1/053* (2006.01)

(56) References Cited

U.S. PATENT DOCUMENTS

| | | | | |
|---|---|---|---|---|
| 10,788,275 | B2 | 9/2020 | Otsuki et al. | |
| 2009/0260586 | A1 | 10/2009 | Geskes et al. | |
| 2017/0003089 | A1* | 1/2017 | Park | F28F 21/085 |
| 2020/0173740 | A1* | 6/2020 | Sohn | F28F 19/06 |

FOREIGN PATENT DOCUMENTS

| | | | |
|---|---|---|---|
| JP | 3217607 | B2 | 10/2001 |
| JP | 2016-205653 | A | 12/2016 |
| JP | 6968598 | B2 | 11/2021 |
| KR | 10-0809385 | B1 | 3/2008 |
| KR | 10-2014-0013040 | A | 2/2014 |
| KR | 10-2014-0138229 | A | 12/2014 |
| KR | 10-1594625 | B1 | 2/2016 |
| KR | 10-1650653 | A | 8/2016 |
| KR | 10-2017-0004845 | A | 1/2017 |
| KR | 10-2017-0116726 | A | 10/2017 |

OTHER PUBLICATIONS

International Search Report (PCT/ISA/210) issued Jul. 7, 2022 from the International Searching Authority in International Application No. PCT/KR2022/003746.

Office Action issued Nov. 28, 2025 by the Korean Ministry of Intellectual Property in Korean Patent Application No. 10-2021-0035262.

* cited by examiner

HEAT EXCHANGER AND AIR CONDITIONER HAVING SAME

CROSS-REFERENCE TO RELATED APPLICATIONS

This application is a continuation of International Application No. PCT/KR2022/003746, filed on Mar. 17, 2022, in the Korean Intellectual Property Receiving Office, which is based on and claims priority to Korean Patent Application No. 10-2021-0035262, filed on Mar. 18, 2021, in the Korean Intellectual Property Office, the disclosures of which are incorporated herein by reference in their entireties.

BACKGROUND

1. Field

The disclosure relates to a heat exchanger and an air conditioner including the same.

2. Description of Related Art

In general, air conditioners adjust temperature, humidity, and the like to be suitable for human activities using a refrigeration cycle. Main components of the refrigeration cycle include a compressor, a condenser, an evaporator, an expansion valve, and a blower fan.

Air conditioners are classified into separate-type air conditioners in which an indoor unit is installed separately from an outdoor unit, and integrated-type air conditioners in which an indoor unit and an outdoor unit are installed together in a single cabinet. Among them, an indoor unit of a separate-type air conditioner includes a heat exchanger configured to exchange heat of air sucked into a panel from a room and a blower fan configured to suck the air of the room and blow the sucked air back into the room.

A heat exchanger, as a device constituting the air conditioner, may serve as a condenser or an evaporator. The heat exchanger is formed of a refrigerant pipe that guides a refrigerant, and the refrigerant pipe may be connected to a plurality of heat-exchanger fins to increase heat exchange efficiency.

Heat exchangers including a microchannel tube as the refrigerant pipe are known to have superior heat transfer characteristics to other types of heat exchangers and have been used as heat exchangers of air conditioners.

Aluminum, as a structural metal with higher price competitiveness and lower specific gravity than copper (Cu), has been widely used in extrusion processes due to excellent processibility thereof. Recently, aluminum has been applied to microchannel tubes of heat exchangers to increase energy efficiency.

Although heat exchange efficiencies of microchannel tubes are significantly higher than those of fin-type or microchannel tubes, the microchannel tubes are vulnerable to corrosion resistance due to lower thicknesses thereof than those of the fin-type or and microchannel tubes. Particularly, because components of heat exchangers replacing those formed of copper have low corrosion resistance, there is a need to develop aluminum microchannel tubes having high corrosion resistance.

SUMMARY

Provided are a heat exchanger that may have improved corrosion resistance by adjusting alloy compositions of a tube, a heat-exchanger fin, and a filler to protect the tube by inducing sacrificial corrosion of the heat-exchanger fin in a corrosive environment.

Additional aspects will be set forth in part in the description which follows and, in part, will be apparent from the description, or may be learned by practice of the presented embodiments.

According to an aspect of the disclosure, a heat exchanger includes a plurality of tubes in which a refrigerant flows, heat-exchanger fins provided between the plurality of tubes, and a filler coupling the heat-exchanger fins to the plurality of tubes, wherein each of the plurality of tubes includes a first aluminum alloy, each of the heat-exchanger fins includes a second aluminum alloy, the filler includes a third aluminum alloy, the plurality of tubes have a corrosion potential of −745 mV to −695 mV, the filler has a corrosion potential of −810 mV to −720 mV, and the heat-exchanger fins have a corrosion potential of −810 mV to −740 mV.

The first aluminum alloy may include an alloy composition of Al-aMn-bMg-cZn-dCr-eGa, where a, b, c, d, and e satisfy: $70 \le 52a - 11.6b - 87c + 0.15d - 0.37e \le -70$, and $0.25 \le a \le 1.2$, $0.05 \le b \le 1.2$, $0.05 \le c \le 1.0$, $d \le 0.2$, and $e \le 0.1$.

Each of the plurality of tubes may further include at least one of misch metal, yttrium (Y), and scandium (Sc) in an amount less than about 0.1 wt %.

The second aluminum alloy may include an alloy composition of Al-xMn-yMg-zZn, where x, y, and z satisfy: $-90 \le 52x - 11.6y - 87z \le 70$ and $x \le 2$, $y \le 0.3$, and $z \le 2.7$.

Each of the heat-exchanger fins may include less than about 0.7 wt % of Mn and less than about 1 wt % of each of Mg and Zn.

The third aluminum alloy may include an alloy composition of Al-mSi-nZn, where m and n satisfy: $-110 \le 2.7m - 87n \le 40$, and where $m \le 10$ and $n \le 1.3$.

The filler may include less than about 1.3 wt % of Zn.

According to an aspect of the disclosure, an air conditioner includes a compressor, an indoor heat exchanger, an outdoor heat exchanger, and an expansion valve, where at least one of the indoor heat exchanger and the outdoor heat exchanger may include a plurality of tubes in which a refrigerant flows, heat-exchanger fins provided between the plurality of tubes, and a filler coupling the heat-exchanger fins to the plurality of tubes, wherein each of the plurality of tubes comprises a first aluminum alloy, each of the heat-exchanger fins comprises a second aluminum alloy, the filler comprises a third aluminum alloy, the plurality of tubes have a corrosion potential of −745 mV to −695 mV, the filler has a corrosion potential of −810 mV to −720 mV, and the heat-exchanger fins have a corrosion potential of −810 mV to −740 mV.

The first aluminum alloy may include an alloy composition of Al-aMn-bMg-cZn-dCr-eGa, where a, b, c, d, and e satisfy: $70 \le 52a - 11.6b - 87c + 0.15d - 0.37e \le -70$, and $0.25 \le a \le 1.2$, $0.05 \le b \le 1.2$, $0.05 \le c \le 1.0$, $d \le 0.2$, and $e \le 0.1$.

Each of the plurality of tubes may further include at least one of misch metal, yttrium (Y), and scandium (Sc) in an amount less than about 0.1 wt %.

The second aluminum alloy may include an alloy composition of Al-xMn-yMg-zZn, where x, y, and z satisfy: $-90 \le 52x - 11.6y - 87z \le 70$ and $x \le 2$, $y \le 0.3$, and $z \le 2.7$.

Each of the heat-exchanger fins may include less than about 0.7 wt % of Mn and less than about 1 wt % of each of Mg and Zn.

The third aluminum alloy may include an alloy composition of Al-mSi-nZn, where m and n satisfy: $-110 \le 2.7m - 87n \le 40$, and where $m \le 10$ and $n \le 1.3$.

The filler may include less than about 1.3 wt % of Zn.

According to an aspect of the disclosure, a tube includes an aluminum alloy including an alloy composition of Al-aMn-bMg-cZn-dCr-eGa, wherein the tube has a corrosion potential of −745 mV to −695 mV, a, b, c, d, and e satisfy: $70 \leq 52a-11.6b-87c+0.15d-0.37e \leq -70$, and $0.25 \leq a \leq 1.2$, $0.05 \leq b \leq 1.2$, $0.05 \leq c \leq 1.0$, $d \leq 0.2$, and $e \leq 0.1$

BRIEF DESCRIPTION OF DRAWINGS

The above and other aspects, features, and advantages of certain embodiments of the present disclosure will be more apparent from the following description taken in conjunction with the accompanying drawings, in which.

DETAILED DESCRIPTION

Figure 1:
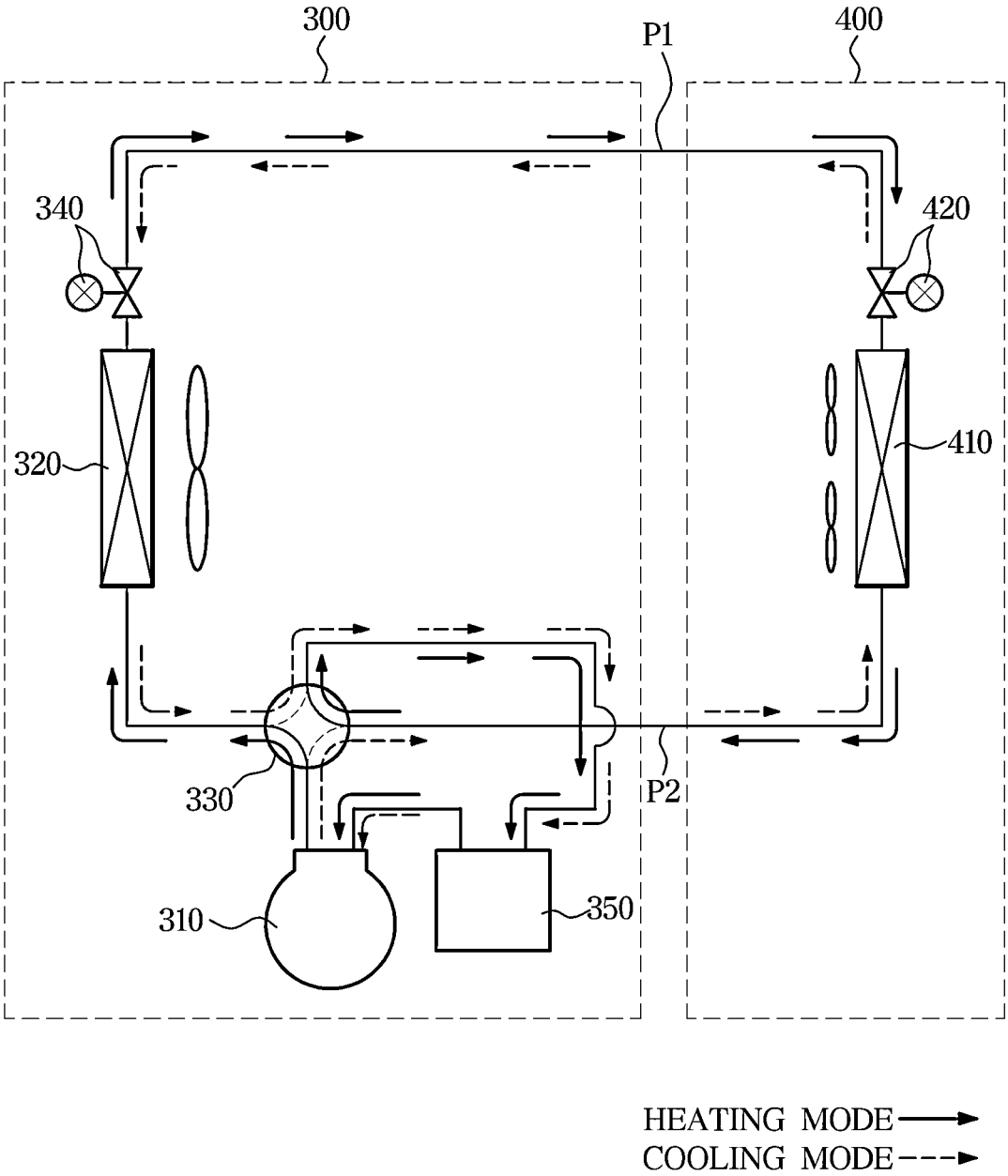
FIG. 1 is a diagram illustrating a configuration related to a flow of a refrigerant of an air conditioner according to an embodiment.

Throughout the specification, like reference numerals refer to like elements throughout. This specification does not describe all elements of the embodiments of the present disclosure and detailed descriptions on what are well known in the art or redundant descriptions on substantially the same configurations may be omitted. The terms 'unit, module, member, and block' used herein may be implemented using a software or hardware component. According to an embodiment, a plurality of 'units, modules, members, and blocks' may also be implemented using an element and one 'unit, module, member, and block' may include a plurality of elements.

Throughout the specification, when an element is referred to as being "connected to" another element, it may be directly or indirectly connected to the other element and the "indirectly connected to" includes connected to the other element via a wireless communication network.

Also, it is to be understood that the terms "include" or "have" are intended to indicate the existence of elements disclosed in the specification, and are not intended to preclude the possibility that one or more other elements may exist or may be added.

Throughout the specification, it will be understood that when one element, is referred to as being "on" another element, it can be directly on the other element, or intervening elements may also be present therebetween.

Throughout the specification, terms "first", "second", and the like are used to distinguish one component from another, without indicating alignment order, manufacturing order, or importance of the components.

An expression used in the singular encompasses the expression of the plural, unless otherwise indicated.

The reference numerals used in operations are used for descriptive convenience and are not intended to describe the order of operations and the operations may be performed in a different order unless the order of operations is clearly stated.

Hereinafter, operating principles and embodiments of the present disclosure will be described with reference to the accompanying drawings.

In general, a heat exchanger is a device that exchanges heat between a refrigerant and external air by including a tube in which a refrigerant flows and configured to exchange heat with external air, a heat-exchanger fin contacting the tube to enlarge a heat dissipation area, and a header connecting both ends of the tube.

Such heat exchangers may be applied in various forms within a range enabling heat transfer between a high-temperature liquid and a low-temperature liquid. For example, the heat exchanger may be applied to various fields such as recovery of waste heat, cooling of a high temperature fluid, heating of a low-temperature fluid, condensation of a vapor, and evaporating the low-temperature fluid.

The heat exchanger may be applied to a variety of apparatuses such as air conditioners and refrigerators. Before describing a heat exchanger, hereinafter, an application examples of a heat exchanger to an air conditioner will be described by way of example.

FIG. 1 is a diagram illustrating a configuration related to a flow of a refrigerant of an air conditioner according to an embodiment.

Referring to FIG. 1, an air conditioner 200 according to an embodiment includes, together with an outdoor unit 300 and an indoor unit 400, a gas pipe P1 serving as a passage of a gas-phase refrigerant and a liquid pipe P2 serving as a passage of a liquid-phase refrigerant, both connecting the outdoor unit 300 with the indoor unit 40. The gas pipe P1 and the liquid pipe P2 extend to the insides of the outdoor unit 300 and the indoor unit 400.

The outdoor unit 300 includes a compressor 310 configured to compress a refrigerant, an outdoor heat exchanger 320 configured to perform heat exchange between external air and the refrigerant, a four-way valve 330 configured to guide the refrigerant compressed in the compressor 310 selectively toward the outdoor heat exchanger 320 or the indoor unit 400 in accordance with a cooling or heating mode, and an outdoor expansion valve 340 configured to decompress the refrigerant guided to the outdoor heat exchanger 320 in the heating mode, and an accumulator 350 configured to prevent the liquid-phase refrigerant, which has not been evaporated, from entering the compressor 310.

The compressor 310 may compress a low-pressure gas-phase refrigerant by a high pressure using a rotational force of a compressor motor that rotates upon receiving electrical energy from an external power source.

The four-way valve 330 guides the refrigerant compressed in the compressor 310 toward the outdoor heat exchanger 320 during the cooling mode and guides the refrigerant compressed in the compressor 310 toward the indoor unit 400.

Figure 2:
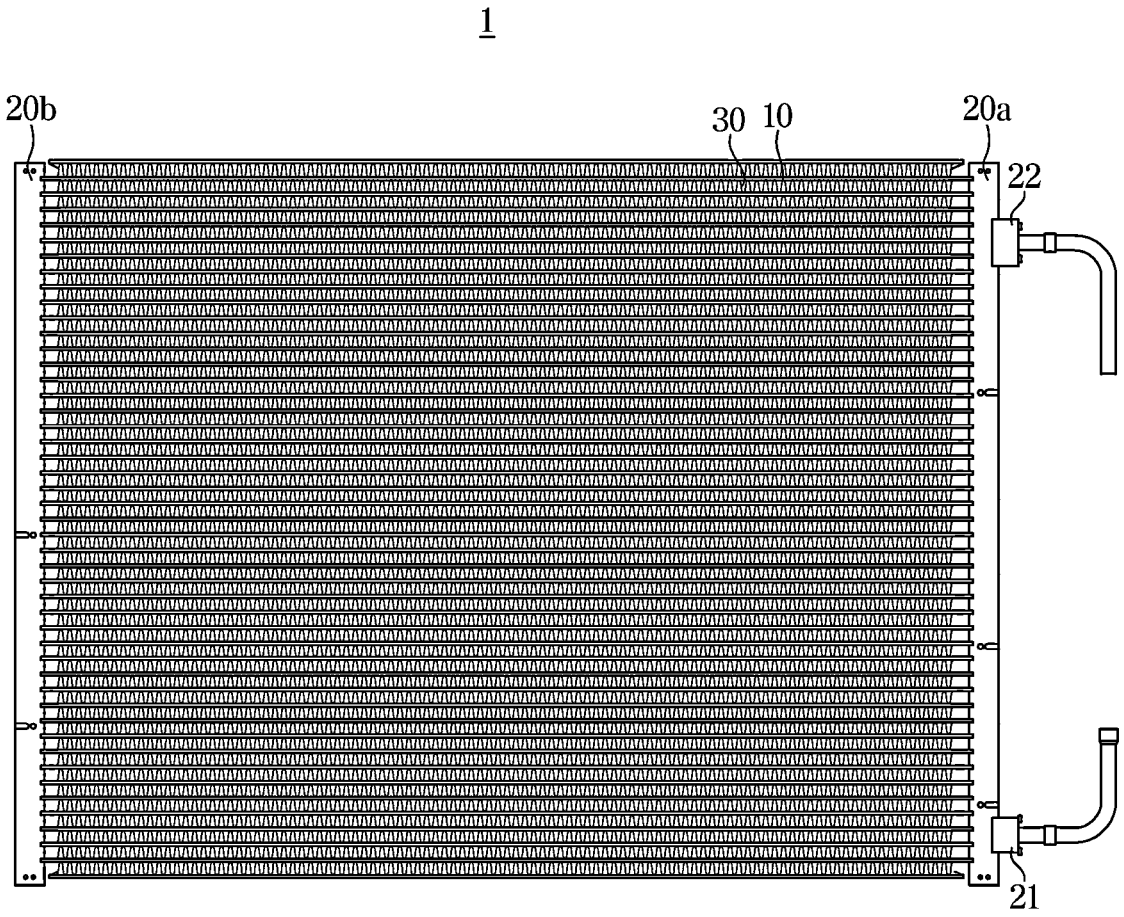
FIG. 2 is a diagram illustrating an exterior appearance of a heat exchanger according to an embodiment.
Figure 3:
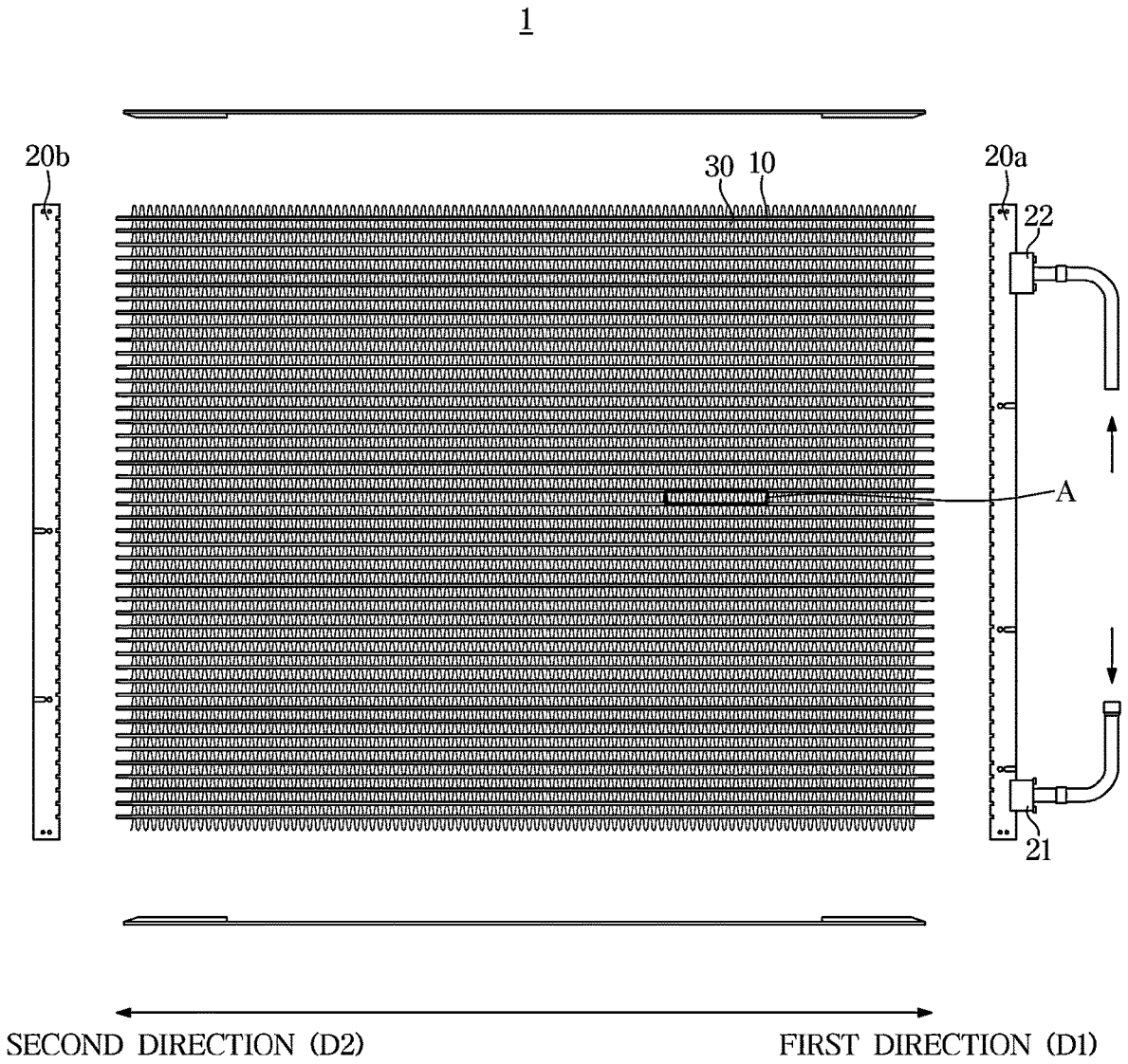
FIG. 3 is a diagram illustrating a heat exchanger according to an embodiment.

FIG. 2 is a diagram illustrating an exterior appearance of a heat exchanger according to an embodiment. FIG. 3 is a diagram illustrating a heat exchanger according to an embodiment.

Referring to FIGS. 1-3, the outdoor heat exchanger 320 condenses the refrigerant compressed in the compressor 310 during the cooling mode and evaporates the refrigerant decompressed in the indoor unit 400 during the heating mode. A heat exchanger 1 according to an embodiment of the present disclosure may be applied to the outdoor heat exchanger 320. In other words, the heat exchanger may include a tube 10 in which a refrigerant flows, and a heat-exchanger fin 30 coupled to the surface of the tube 10, wherein the tube 10 may be coupled to the heat-exchanger fin 30 by a filler 36. Hereinafter, duplicate descriptions will be omitted.

The outdoor expansion valve 340 may adjust an amount of the refrigerant supplied to the outdoor heat exchanger 320 not only to decompress the refrigerant but also to sufficiently perform heat exchange in the outdoor heat exchanger 320 during the heating mode. Specifically, the outdoor expansion valve 340 may decompress by using throttling effect of the refrigerant in which the refrigerant is decompressed while passing through a narrow flow channel without heat exchange with an external environment.

The indoor unit 400 includes an indoor heat exchanger 410 configured to perform heat exchange between internal air and the refrigerant, and an indoor expansion valve 420 configured to decompress the refrigerant supplied to the indoor heat exchanger 410 during the cooling mode.

The indoor heat exchanger 410 may evaporate a low-pressure, liquid-phase refrigerant during the cooling mode and may condense a high-pressure refrigerant during the heating mode. The heat exchanger 1 according to an embodiment may be applied to the indoor heat exchanger 410, and duplicate descriptions will be omitted for descriptive convenience.

The indoor expansion valve 420 may not only decompress the refrigerant but also adjust the amount of the refrigerant supplied to the outdoor heat exchanger 320 to perform sufficient heat exchange in the indoor heat exchanger 410 by the throttling effect.

An example of applying the heat exchanger 1 according to an embodiment to the air conditioner 200 is described above.

Hereinafter, the heat exchanger 1 according to the present disclosure will be described in more detail.

Figure 4:
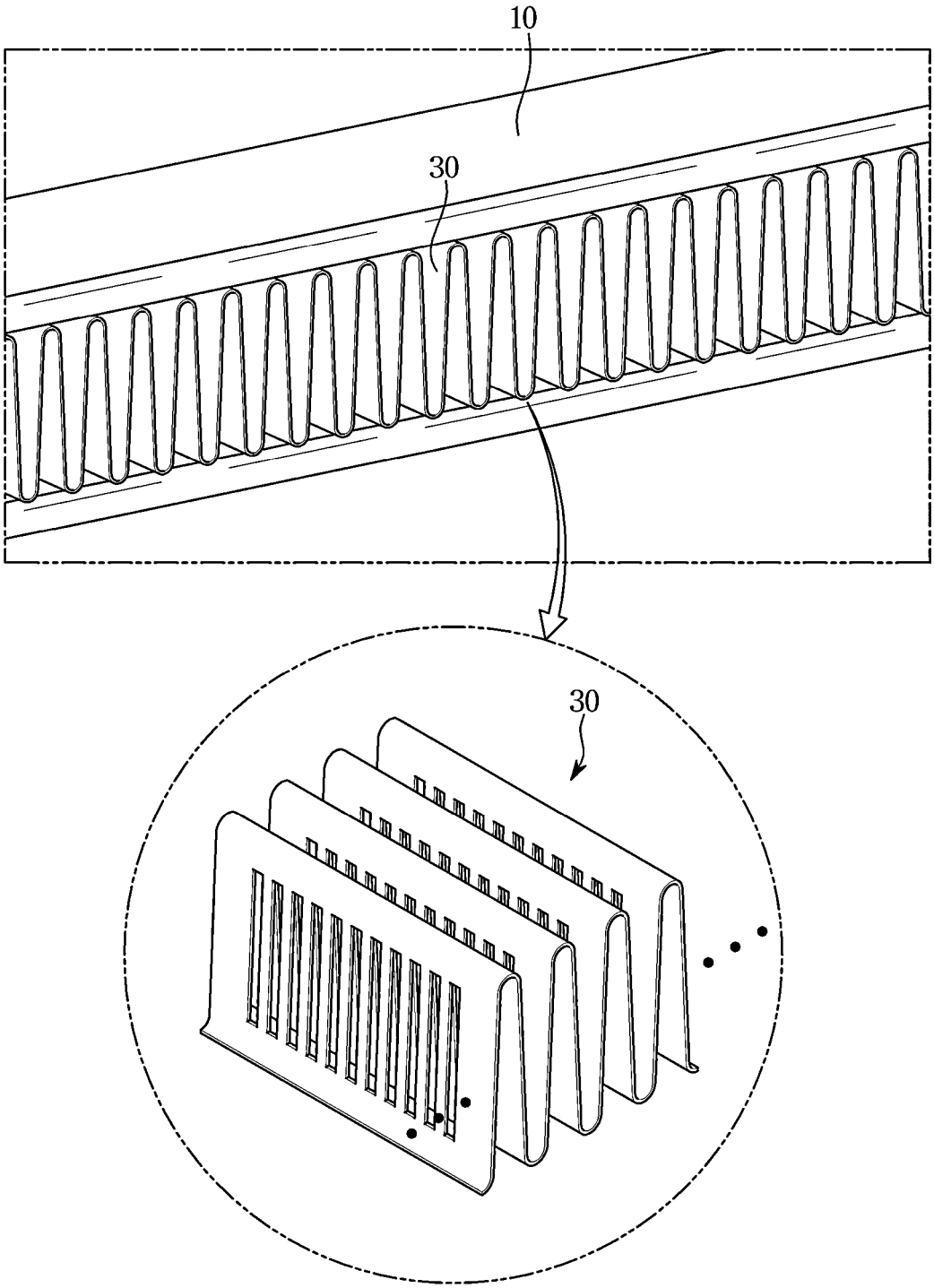
FIG. 4 is a magnified diagram of portion A of FIG. 3 according to an embodiment.
Figure 5:
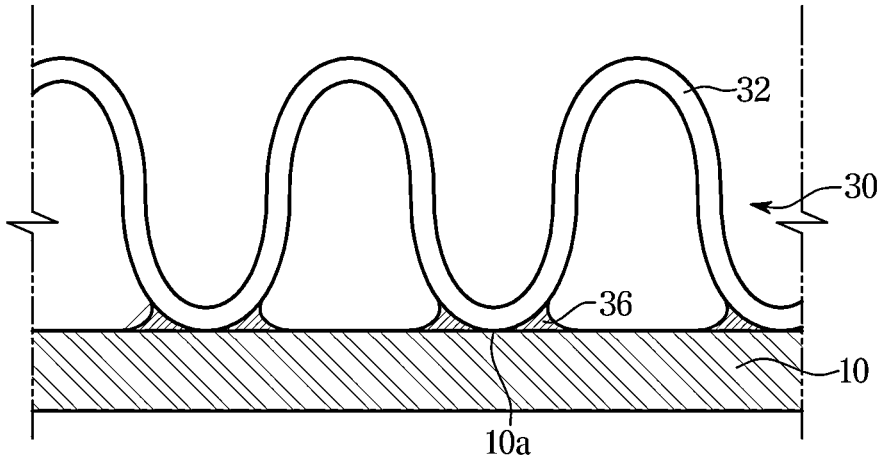
FIG. 5 is a diagram illustrating a joined example of a heat-exchanger fin and a tube of a heat exchanger according to an embodiment.

FIG. 4 is a magnified diagram of portion A of FIG. 3 according to an embodiment. FIG. 5 is a diagram illustrating a joined example of a heat-exchanger fin and a tube of a heat exchanger according to an embodiment.

Referring to FIGS. 2 to 5, the heat exchanger 1 according to an embodiment may include a plurality of tubes 10, headers 20*a* and 20*b*, and a plurality of heat-exchanger fins 30.

The plurality of tubes 10 may be arranged parallel to each other and may have a channel in which a refrigerant, as a fluid, may flow. In addition, the plurality of tubes 10 may be coupled to each other to form a tube assembly.

The refrigerant may exchange heat with external air by phase change (compression) from a gas-phase to a liquid-phase or by phase change (expansion) from the liquid-phase to the gas-phase. The heat exchanger 1 may be used as a condenser during the phase change of the refrigerant from the gas-phase to the liquid-phase, and the heat exchanger 1 may be used as an evaporator during the phase change of the refrigerant from the liquid-phase to the gas-phase.

The plurality of tubes 10 may be extrusion-molded and injection-molded, and hereinafter, a case where a plurality of tubes 10 is extrusion-molded will be described by way of example. According to an embodiment, a connecting member may be coupled to both ends of the plurality of tubes 10. A connecting member 12 may be coupled to both ends of the plurality of tubes 10 to form a tube array.

The headers 20*a* and 20*b* may include a first header 20*a* and a second header 20*b* coupled to outer sides of the connecting member. The first header 20*a* may face in a first direction, and the second header 20*b* may be coupled to the outer sides of the tubes 10 to face a second direction B. The first header 20*a* and the second header 20*b* may be arranged to be spaced apart from each other by a constant interval, and a plurality of tubes 10 may be arranged between the first header 20*a* and the second header 20*b*.

One end of each of the plurality of tubes 10 facing the first direction D1 may be connected to the first header 20*a*, and the other end of each of the plurality of tubes 10 facing the second direction D2 may be connected to the second header 20*b*. However, the structure in which the headers 20*a* and 20*b* and the plurality of tubes 10 are arranged is not limited to the above-described example.

The first header 20*a* may include an inlet header 21 and an outlet header 22, and the inlet header 21 may have an inlet through which the refrigerant is introduced into the plurality of tubes 10 and an outlet header 22 may have an outlet through which the refrigerant is discharged from the plurality of tubes 10.

According to an embodiment, the inlet header 21 may be provided at the second header 20*b* or the outlet header 22 may be provided at the second header 20*b* such that the inlet header and the outlet header face different directions.

The heat-exchanger fin 30 may be provided between the plurality of tubes 10 such that heat exchange between the refrigerant flowing in the channel formed in the tubes 10 and external air is efficiently performed. That is, the heat-exchanger fin 30 may be arranged to be in contact with the tube 10 in a heat exchange space.

A contact region where the plurality of heat-exchanger fins 30 and the plurality of tubes 10 are joined together may be fixed by brazing. Brazing is a metal-joining process by melting a filler metal at a high temperature. In this case, the filler metal may be a metal having a lower melting point than a metal to which the filler metal is joined.

Figure 6:
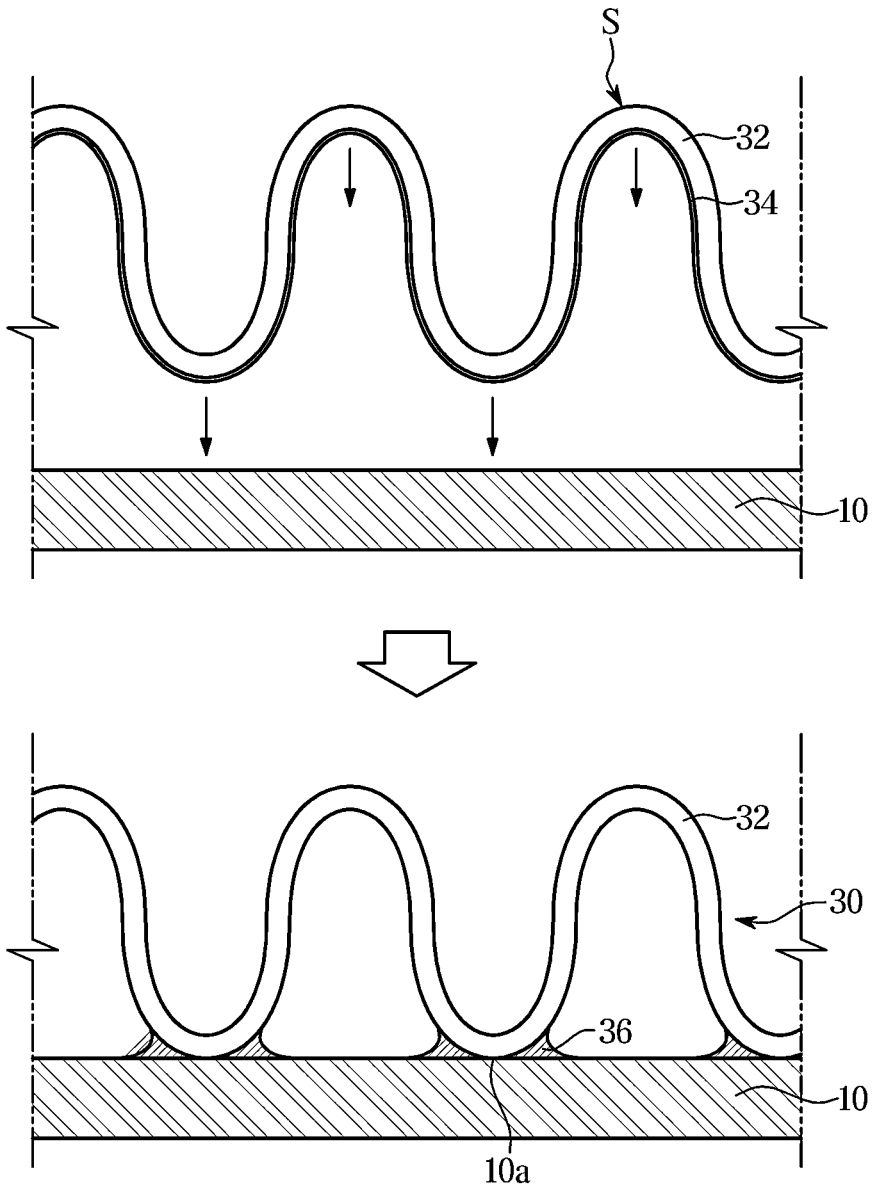
FIG. 6 is a diagram illustrating a process of brazing a heat-exchanger fin to a plurality of tubes.

FIG. 6 is a diagram illustrating a process of brazing a plurality of tubes 10 with a heat-exchanger fin 30. Hereinafter, a shape of a joint between the tube 10 and the heat-exchanger fin 30 will be described in more detail referring to FIG. 6.

Referring to FIG. 6, the heat-exchanger fin 30 may be provided in a shape bent multiple times. More specifically, the heat-exchanger fin 30 may include a first slope inclined upward in the first direction and a second slope extending from the first slope and inclined downward in the first direction. In this regard, the first direction is defined as a direction where the heat-exchanger fin 30 extends along a contact region between the tube 10 and the heat-exchanger fin 30. The heat-exchanger fin 30 may be provided in a zigzag shape in which a plurality of first slopes and a plurality of second slopes are combined. According to an embodiment, the heat-exchanger fin 30 may be formed in various shapes to enlarge a surface in contact with external air, and a bent portion in which the first slope is connected to the second slope may be installed at an inner surface of a contact region 10*a* contacting the tube 10 to bring about heat exchange.

A fin material of the heat-exchanger fin 30 may be a brazing sheet type fin material that may be brazed at a high temperature. Such a brazing sheet S may include a core layer 32 and a clad layer 34 formed on one or both surfaces of the core layer 32.

In the case where the clad layer 34 is formed on one surface of the core layer 32, brazing may be performed in a state where a clad surface of the clad layer 34 and the tube 10 face each other during the brazing of the tube 10 with the heat-exchanger fin 30. According to an embodiment, the clad layer 34 may be formed on both surfaces of the core layer 32 in the case of locating the heat-exchanger fin 30 between the plurality of tubes 10.

During a brazing process, high-temperature heat may be applied to the clad layer 34, and thus the clad layer 34 is melted to fix the contact region 10*a* between the tube 10 and the heat-exchanger fin 30. Hereinafter, a joined portion formed between the core layer 32 of the heat-exchanger fin 30 and the tube 10 by the melted clad layer 34 of the heat-exchanger fin 30 is defined as a filler 36.

The filler 36 is formed as the clad layer 34 of the heat-exchanger fin 30 is melted and components thereof may be identical to those of the clad layer 34. In other words, an aluminum alloy formed by the melted clad layer 34 may constitute the filler 36.

The tube 10, the heat-exchanger fin 30, and the filler 36 of the heat exchanger 1 according to an embodiment are formed of aluminum alloys. In the case where the heat exchanger is in a corrosive environment, the heat-exchanger fin having a large amount of a high potential alloy may be corroded, and the corrosion of the heat-exchanger fin may induce corrosion of the tube due to a potential difference between the tube and the heat-exchanger fin, thereby causing leakage of the refrigerant.

A method of preventing corrosion of a tube by applying Zn thermal spray coating to a heat exchanger may be used. Corrosion of the tube may be prevented by inducing corrosion of a Zn diffusion layer with a lower electric potential prior to that of the tube.

Formation of a Zn diffusion layer with a constant concentration and a uniform thickness on the tube may improve corrosion resistance of the tube. However, zinc diffuses toward the tube during brazing to form a thick Zn diffusion layer. Thus, sacrificial corrosion effect of the heat-exchanger fin may not be obtained due to a potential difference between an electric potential of a surface layer of the tube having a high Zn concentration and a heat-exchanger fin or a filler, and a problem of pitting corrosion may occur.

In addition, in related art heat exchangers, a tube may include Cu in an amount less than 1 wt % to improve physical properties and increase a potential difference for sacrificial corrosion of a heat-exchanger fin. However, in the case where a tube includes Cu, a fine $Al_2Cu$ phase distributed in an aluminum base material has a higher chemical potential than that of the base material, causing a problem of pitting corrosion on the surface of the tube.

In order to solve the above-described problems, in some embodiments, provided is a heat exchanger capable of protecting the tube by maintaining corrosion resistance of the heat exchanger after brazing and inducing sacrificial corrosion of the heat-exchanger fin in a corrosive environment, although copper is not included as an alloying element and the Zn thermal spraying coating process is omitted.

To this end, in the heat exchanger 1 according to the present disclosure, corrosion resistance of the tube 10 improved by increasing the electrode potential of the tube 10 by optimizing compositions of alloying elements added to the tube 10 and the heat-exchanger fin 30 of the heat exchanger 1. In other words, sacrificial corrosion of the heat-exchanger fin 30 may be induced by designing the heat-exchanger fin 30 to have a low electric potential, resulting in protection of the tube 10 as a result.

The sacrificial corrosion of the heat-exchanger fin 30 as described above is referred to as Galvanic corrosion (or bimetallic corrosion).

Galvanic corrosion occurs when two different metals contact one another and one metal promotes oxidation of the other metal. Corrosion may occur due to a difference in intrinsic electric potentials of the different metals. Specifically, an electric corrosion cell is formed when two different metals in a state of being electrically connected to each other are contacting an electrolyte solution, and corrosion is promoted at one metal serving as an anode due to a lower electric potential and the other metal serving as a cathode due to a higher electric potential is protected.

When the above-described corrosive action is used in reverse, corrosion of metal may be prevented, and this is referred to as cathodic protection. In the heat exchanger 1 according to an embodiment, corrosion of the tube 10 may be prevented by cathodic protection. More specifically, the tube 10 may be protected by designing the tube 10 and the heat-exchanger fin 30 of the heat exchanger 1 to have a potential difference of about 20 mV to 60 mV. However, the above-described numerical range is merely for describing the preferred embodiment of the present disclosure, and embodiments of the disclosure are not limited by the above-described numerical range.

Regarding a design of the potential difference, in the case where the potential difference between the tube 10 and the heat-exchanger fin 30 is excessively large, corrosion of the heat-exchanger fin 30 is accelerated making it difficult to prevent corrosion of the tube 10. In the case where the potential difference between the tube 10 and the heat-exchanger fin 30 is too small, corrosion of the heat-exchanger fin 30 proceeds simultaneously with corrosion of the tube 10 proceeds making it difficult to protect the tube 10. Therefore, in order to prevent corrosion of the tube 10, there is a need to adjust a corrosion potential formed between the tube 10 and the heat-exchanger fin 30 within a certain range in the case where Galvanic pairs are formed between the tube 10 and the outdoor unit 300.

In the same reason, there is a need to appropriately adjust a corrosion potential formed between the heat-exchanger fin 30 and the filler 36 and a corrosion potential formed between the filler 36 and the tube 10. According to an embodiment, the corrosion potentials formed between the heat-exchanger fin 30 and the filler 36 and between the filler 36 and the tube 10 may be adjusted in a range of 10 mV to 50 mV and in a range of 19 mV to 65 mV, respectively. However, the above-described numerical ranges are presented for merely describing the preferred embodiments of the present disclosure and the inventive concept of the disclosure is not limited by the above-described numerical ranges.

In the present disclosure, various materials may be added to each of the aluminum alloy materials used to form the tube 10, the filler 36, and the heat-exchanger fin 30 at various composition ratios to adjust potential differences therebetween. Hereinafter, composition ratios of the aluminum alloy materials will be described in detail.

First, components of an aluminum alloy material of the tube 10 for the heat exchanger 1 according to an embodiment will be described.

The tube 10 of the heat exchanger 1 according to an embodiment may be formed of an aluminum alloy designed based on an Al—Mn—Mg—Zn—Cr—Ga-based alloy and may include the balance of unavoidable impurities such as Fe.

The tube 10 of the heat exchanger 1 according to an embodiment does not include Cu that is added to conventional heat-exchanger tubes. Therefore, a problem of pitting corrosion caused by $Al_2Cu$ which may be generated in the case of including Cu may be prevented resulting in improvement of corrosion resistance of the tube 10.

In the aluminum alloy used to form the tube 10, amounts of alloying elements may be adjusted such that the tube 10 has a higher electric potential than those of the filler 36 and the heat-exchanger fin 30.

The tube 10 is formed of an aluminum alloy having an alloy composition of Al-aMn-bMg-cZn-dCr-eGa to have a corrosion potential of −745 to −695 mV, and a, b, c, d, and e satisfy Equation (1).

$$70 \le 52a - 11.6b - 87c + 0.15d - 0.37e \le -70, \text{ where } 0.25 \le a \le 1.2,\ 0.05 \le b \le 1.2,\ 0.05 \le c \le 1.0,\ d \le 0.2, \text{ and } e \le 0.1 \quad (1)$$

Ga added to the tube 10 forms Ga—Si and Ga—Fe intermetallic compounds, and the size of crystal grains is decreases due to a negative mixing enthalpy of Ga—Si and Ga—Fe, thereby providing an effect on improving corrosion resistance.

The tube 10 may further include at least one alloy element of misch metal, yttrium (Y), and scandium (Sc) to increase joint strength between the tube 10 and the heat-exchanger fin 30 while brazing with the heat-exchanger fin 30.

The tube 10 includes Mg and Zn as described above. By adding Mg and Zn thereto, crystal grains are refined, and fluidity of the material increases during extrusion. Therefore, a pressure of a container mold is reduced and an extrusion speed of the tube 10 is increased.

By adding Mg and Zn thereto, an extrusion speed of the tube 10 may be increased by about 70% or more compared to that of a conventional A3003 aluminum alloy including about 1 wt % of Mn.

Hereinafter, components of the aluminum alloy of the heat-exchanger fin 30 of the heat exchanger 1 according to an embodiment will be described in more detail.

The heat-exchanger fin 30 of the heat exchanger 1 according to an embodiment is formed of an aluminum alloy designed based on an Al—Mn—Mg—Zn alloy. The aluminum alloy forming the heat-exchanger fin 30 includes Mn in an amount less than about 0.7 wt % to obtain a potential difference from that of tube 10.

The heat-exchanger fin 30 is formed of an aluminum alloy having a composition of Al-xMn-yMg-zZn to have a corrosion potential of −810 mV to −740 mV, and x, y, and z satisfy Equation (2).

$$-90 \le 52x - 11.6y - 87z \le 70, \text{ where } x \le 2,\ y \le 0.3, \text{ and } z \le 2.7 \quad (2)$$

In order to improve corrosion resistance, the aluminum alloy used to form the heat-exchanger fin 30 includes Mg and Zn in an amount less than 1 about wt %, respectively, to improve corrosion resistance without artificially adding Cu and Si thereto. More specifically, the heat-exchanger fin 30 includes Mg in an amount of about 0.2 wt % or more and less than about 1 wt % and Zn in an amount of about 0.3 wt % or more and less than 1 about wt %. In addition, the heat-exchanger fin 30 may be heat-treated at a temperature of about 300° C. to about 400° C. to have an electric potential lower than that of the tube 10.

Hereinafter, components of the aluminum alloy of the filler 36 of the heat exchanger 1 according to an embodiment will be described in more detail.

The filler 36 of the heat exchanger 1 according to an embodiment is designed based on a 4000-series aluminum alloy, particularly, an aluminum alloy designed based on an Al—Si—Zn alloy.

The filler 36 is formed of an aluminum alloy having a composition of Al-mSi-nZn to have a corrosion potential of −810 mV to −720 mV, and m and n satisfy Equation (3).

$$-110 \le 2.7m - 87n \le 40, \text{ where } m \le 10 \text{ and } n \le 1.3 \quad (3)$$

Because corrosion resistance rapidly deteriorates in the case of adding Zn in an amount of about 1.3 wt % or more, the filler 36 includes Zn in an amount less than about 1.3 wt %. Also, in the same manner as in the tube 10 and the heat-exchanger fin 30, Cu for improving corrosion resistance is not artificially added to the filler 36.

Figure 7:
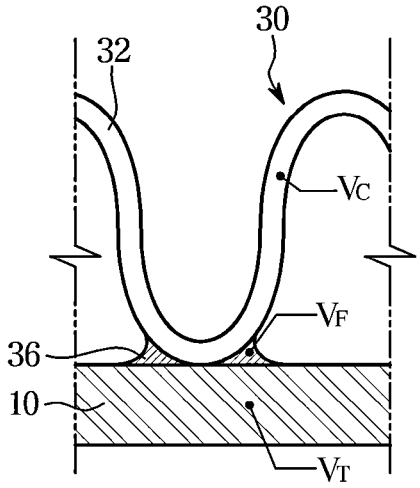
FIG. 7 is a diagram illustrating an example of designing potential differences of a heat exchanger according to an embodiment.
Figure 8:
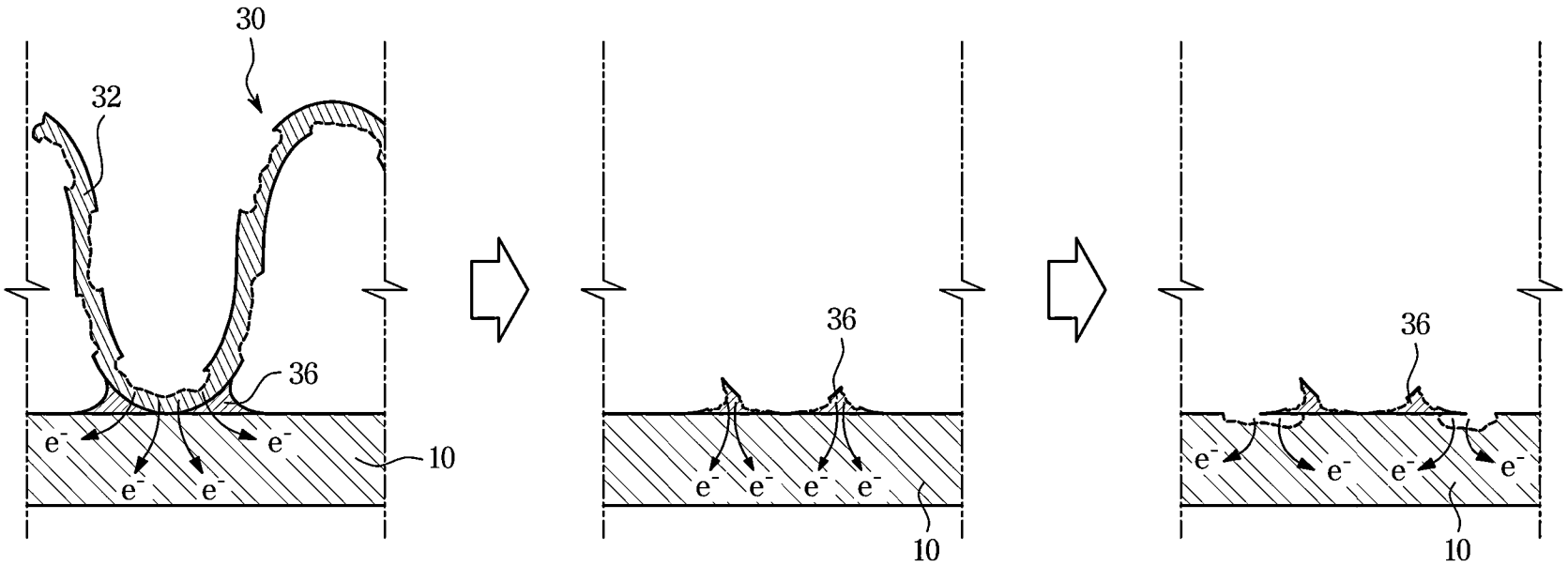
FIG. 8 is a diagram illustrating a corrosion process of a heat exchanger according to an embodiment.

FIG. 7 is a diagram illustrating an example of designing potential differences of a heat exchanger 1 according to an embodiment. FIG. 8 is a diagram illustrating a corrosion process of a heat exchanger 1 according to an embodiment.

Referring to FIG. 7, the heat exchanger 1 formed of the aluminum alloy having the alloy composition according to the above-described embodiment is designed to have an electric potential Vc of the heat-exchanger fin 30, an electric potential Vf of the filler 36, and an electric potential Vt of the tube 10 to satisfy a relationship of Vt>Vf>Vc.

Referring to FIG. 8, due to the potential differences designed as described above, the heat-exchanger fin 30 may be corroded first, and then corrosion of the filler 36 may proceed. While the corrosion of the heat-exchanger fin 30 proceeds, Galvanic pairs between the heat-exchanger fin 30 and the filler 36 or between the heat-exchanger fin 30 and the tube 10 may be formed. In this case, electrons (e−) may migrate in a direction from the heat-exchanger fin 30 to the filler 36 or in a direction from the heat-exchanger fin 30 to the tube 10. As a result, sacrificial corrosion of the heat-exchanger fin 30 may proceed.

After the sacrificial corrosion of the heat-exchanger fin 30 proceeds to some extent, corrosion of the filler 36 may proceed. While corrosion of the filler 36 proceeds, electrons (e−) may migrate in a direction from the filler 36 to the tube 10 or in a direction from the surface of the tube 10 to the inside of the tube 10. Because corrosion of the heat-exchanger fin 30, the filler 36, and the surface of the tube 10 sequentially proceed and then the inside of the tube 10 is lastly corroded, the tube 10 may be protected.

Figure 9:
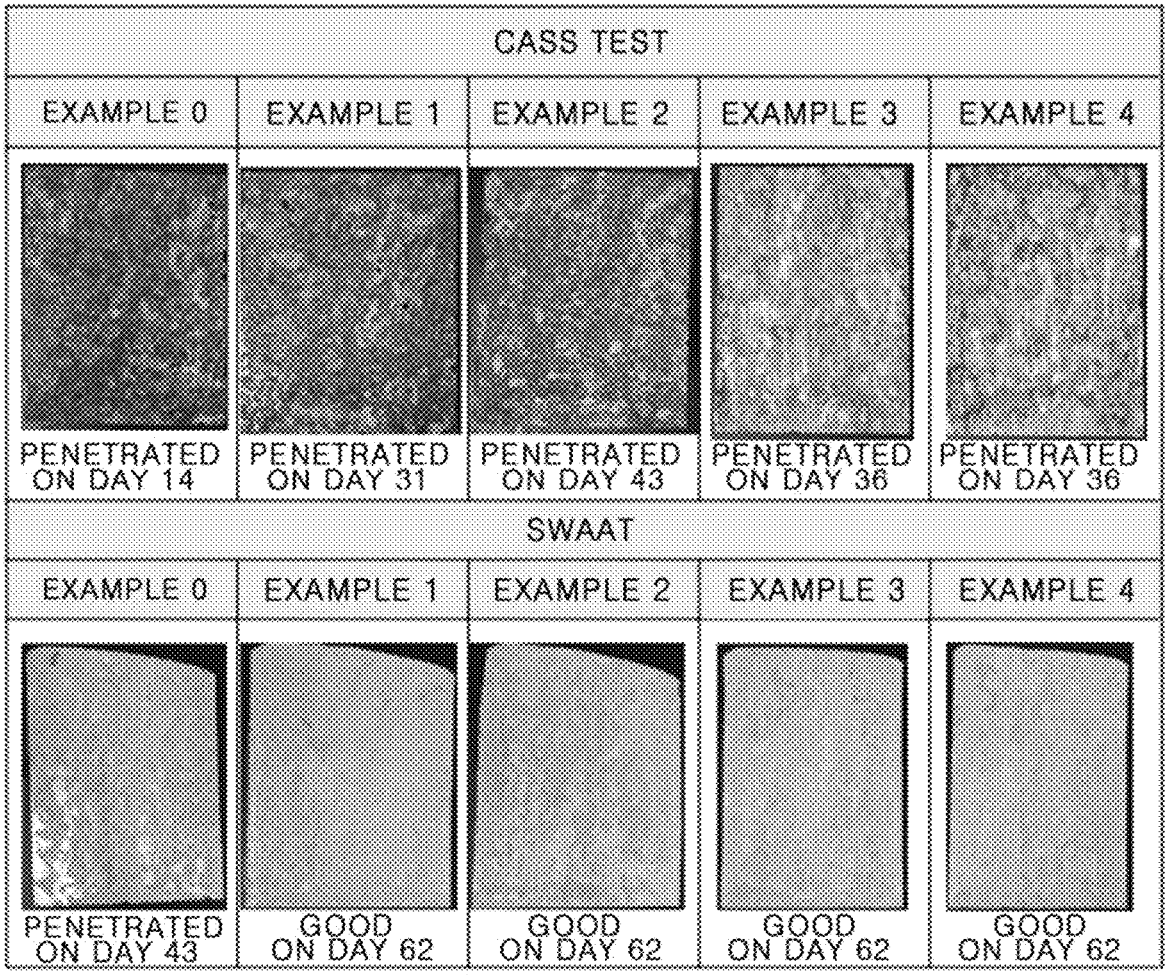
FIG. 9 is a diagram of photographs indicating results of a copper accelerated acetic acid salt spray (CASS) test and a salt water acetic acid test (SWAAT).

FIG. 9 is a diagram of photographs indicating results of a copper accelerated acetic acid salt spray (CASS) test and a salt water acetic acid test (SWAAT).

Corrosion resistance of the tube 10 of the heat exchanger 1 having the alloy composition according to the above-described embodiment was evaluated.

The aluminum alloys having the above-described compositions were processed by casting, heat treatment, hot rolling, rolling at room temperature, and annealing to prepare samples for evaluation, and corrosion resistance of the samples was evaluated by a SWAAT and a CASS test.

The CASS test was performed by spraying a mixed solution of 5% NaCl and $CuCl_2$ with a pH of 3.1 to 3.3 at a rate of 1.0 to 2.0 ml/h for 24 hours. The SWAAT was performed by spraying a 5% NaCl solution with a pH of 2.8 to 3.0 at a rate of 1.0 to 2.0 ml/h for 24 hours.

Test results are shown in Table 1 below. FIG. 9 shows photographs indicating results of a CASS test and a SWAAT. In FIG. 9, "Example 0" may correspond to a comparative example, and "Example 1" through "Example 4" may correspond to example embodiments of the disclosure.

TABLE 1

| Category | | Analysis of corrosion resistance (Thickness: 0.35 t) CASS test | SWAAT |
|---|---|---|---|
| Comparative Example | Example 0 | Penetrated on day 14 | Penetrated on day 43 |
| Embodiment Example | Example 1 | Penetrated on day 31 | Good on day 62 |
| | Example 2 | Penetrated on day 43 | Good on day 62 |
| | Example 3 | Penetrated on day 36 | Good on day 62 |
| | Example 4 | Penetrated on day 36 | Good on day 62 |

The alloy compositions of the Comparative Example (e.g., Example 0) shown in Table 1 are listed in Table 2.

TABLE 2

| Tube | wt % (analysis value) Si | Fe | Cu | Mn | Ce | La | Mg | Cr | Zn | Ti |
|---|---|---|---|---|---|---|---|---|---|---|
| Example 0 | 0.07 | 0.16 | 0.01 | 0.30 | — | — | — | — | — | — |

The sample of Example 1 has an alloy composition of Al-0.5Mn-0.25Mg-0.31Zn—Ga, and the sample of Example 2 has an alloy composition of Al-0.7Mn-0.25Mg-0.31Zn—Ga. The sample of Example 3 has an alloy composition of Al-0.5Mn-0.1Mg-0.1Zn-0.1Cr, and the sample of Example 4 has an alloy composition of Al-0.7Mn-0.1Mg-0.1Zn-0.1Cr.

Referring to Table 1 and FIG. 9, it may be confirmed that the samples of Embodiment Examples 1, 2, 3 and 4 have excellent corrosion resistance twice as high as that of Comparative Example (i.e., Example 0) including Cu based on the results of the CASS test and the SWAAT.

Analysis results of electric potentials of the tube 10, the heat-exchanger fin 30, and the filler 36 of the heat exchanger 1 having the above-described alloy compositions are shown in Table 3 below.

TABLE 3

| Category | | Electric potential (mV) |
|---|---|---|
| Tube | Example 1 (Al—0.5Mn—0.25Mg—0.31Zn—Ga) | −739 |
| | Example 2 (Al—0.7Mn—0.25Mg—0.31Zn—Ga) | −727 |
| | Example 3 (Al—0.5Mn—0.1Mg—0.1Zn—0.1Cr) | −705 |
| | Example 4 (Al—0.7Mn—0.1Mg—0.1Zn—0.1Cr) | −695 |
| Heat-exchanger fin | Example 1 (Al—0.5Mn—0.5Mg—0.5Zn) | −758 |
| | Example 2 (Al—1.6Mn—0.3Mg—1.4Zn) | −778 |
| | Example 3 (Al—1.6Mn—1.0Zn) | −744 |
| | Example 4 (Al—1.6Mn—1.4Zn) | −776 |
| | Example 5 (Al—1.6Mn—1.6Zn) | −797 |
| Filler | Example 1 (Al—10Si—0.5Zn) | −755 |
| | Example 2 (Al—8Si—0.5Zn) | −755 |
| | Example 3 (Al—6Si—0.5Zn) | −755 |
| | Example 4 (Al—7.8Si—0.2Zn) | −720 |
| | Example 5 (Al—7.8Si—0.4Zn) | −743 |
| | Example 6 (Al—7.8Si—1.0Zn) | −764 |

As shown in Table 3, electric potentials of the tube 10, the heat-exchanger fin 30, and the filler 36 according to the examples were designed as follows. The heat-exchanger fin 30 had the lowest electric potential, the tube 10 had the highest electric potential, and the filler 36 had an intermediate electric potential therebetween. Therefore, it may be confirmed that corrosion may proceed in the heat exchanger 1 in the order of the heat-exchanger fin 30, the filler 36, and the tube 10 in a corrosive environment.

Table 4 below shows results of the CASS test performed on the heat exchanges manufactured using the tube, the filler, and the heat-exchanger fin according to some examples among the above-described examples of the tube, the filler, and the heat-exchanger fin.

TABLE 4

| Category | Heat exchanger | | CASS test |
|---|---|---|---|
| Comparative Example (Example 0) | Tube | Example 0 (Table 2) (Al—7.1Si) | leakage of refrigerant on day 25 |
| | Filler | | |
| | Heat-exchanger fin | Example 4 (Table 3) (Al—1.6Mn—1.4Zn) | |
| Embodiment Example 1 | Tube | Example 2 (Table 3) | Over 50 days |
| | Filler | Example 5 (Table 3) | |
| | Heat-exchanger fin | Example 5 (Table 3) | |
| Embodiment Example 2 | Tube | Example 3 (Table 3) | Over 50 days |
| | filler | Example 6 (Table 3) | |
| | Heat-exchanger fin | Example 5 (Table 3) | |

As shown in Table 4, it may be confirmed that the heat exchangers manufactured using the tube, the filler, and the heat-exchanger fin according to Embodiment Examples 1 and 2 had excellent corrosion resistance twice as high as that of the heat exchanger according to the Comparative Example based on the CASS test results.

According to embodiments of the present disclosure, a heat exchanger including a tube with improved corrosion resistance by inducing sacrificial corrosion of a heat-exchanger fin and an air conditioner including the same may be provided.

Also, according to embodiments of the present disclosure, a manufacturing process of a heat exchanger may be simplified by omitting a Zn-spraying process in a process of manufacturing a tube of the heat exchanger Although the present disclosure has been described with example embodiments, various changes and modifications may be suggested to one skilled in the art. It is intended that the present disclosure encompass such changes and modifications as fall within the scope of the claims.

What is claimed is:

1. A heat exchanger comprising:

a plurality of tubes in which a refrigerant flows;

heat-exchanger fins provided between the plurality of tubes; and a filler coupling the heat-exchanger fins to the plurality of tubes, wherein each of the plurality of tubes comprises a first aluminum alloy that comprises an alloy composition including Ga, wherein each of the heat-exchanger fins comprises a second aluminum alloy, wherein the filler comprises a third aluminum alloy, wherein the plurality of tubes have a corrosion potential of −745 mV to −695 mV, wherein the filler has a corrosion potential of −810 mV to −720 mV, and wherein the heat-exchanger fins have a corrosion potential of −810 mV to −740 mV.

2. The heat exchanger of claim 1, wherein the alloy composition of the first aluminum alloy is Al-aMn-bMg-cZn-dCr-eGa, and wherein a, b, c, d, and e satisfy: $70 \leq 52a - 11.6b - 87c + 0.15d - 0.37e \leq -70$, and $0.25 \leq a \leq 1.2$, $0.05 \leq b \leq 1.2$, $0.05 \leq c \leq 1.0$, $d \leq 0.2$, and $e \leq 0.1$.

3. The heat exchanger of claim 2, wherein each of the plurality of tubes further comprises at least one of misch metal, yttrium (Y), and scandium (Sc) in an amount less than about 0.1 wt %.

4. The heat exchanger of claim 1, wherein the second aluminum alloy comprises an alloy composition of Al-xMn-yMg-zZn, wherein x, y, and z satisfy: $-90 \leq 52x - 11.6y - 87z \leq 70$, and $x \leq 2$, $y \leq 0.3$, and $z \leq 2.7$.

5. The heat exchanger of claim 4, wherein each of the heat-exchanger fins comprises less than about 0.7 wt % of Mn and less than about 1 wt % of each of Mg and Zn.

6. The heat exchanger of claim 1, wherein the third aluminum alloy comprises an alloy composition of Al-mSi-nZn, wherein m and n satisfy: $-110 \leq 2.7m - 87n \leq 40$, and $m \leq 10$ and $n \leq 1.3$.

7. The heat exchanger of claim 6, wherein the filler comprises less than about 1.3 wt % of Zn.

8. An air conditioner comprising:

a compressor;

an indoor heat exchanger;

an outdoor heat exchanger; and an expansion valve, wherein at least one of the indoor heat exchanger and the outdoor heat exchanger comprises:

a plurality of tubes in which a refrigerant flows;

heat-exchanger fins provided between the plurality of tubes; and a filler coupling the heat-exchanger fins to the plurality of tubes, wherein each of the plurality of tubes comprises a first aluminum alloy that comprises an alloy composition including Ga, wherein each of the heat-exchanger fins comprises a second aluminum alloy, wherein the filler is formed of a third aluminum alloy, wherein the plurality of tubes have a corrosion potential of −745 mV to −695 mV, wherein the filler has a corrosion potential of −810 mV to −720 mV, and wherein the heat-exchanger fins have a corrosion potential of −810 mV to −740 mV.

9. The air conditioner of claim 8, wherein the alloy composition of the first aluminum alloy is of Al-aMn-bMg-cZn-dCr-eGa, and wherein a, b, c, d, and e satisfy: $70 \leq 52a - 11.6b - 87c + 0.15d - 0.37e \leq -70$, and $0.25 \leq a \leq 1.2$, $0.05 \leq b \leq 1.2$, $0.05 \leq c \leq 1.0$, $d \leq 0.2$, and $e \leq 0.1$.

10. The air conditioner of claim 9, wherein each of the plurality of tubes further comprises at least one of misch metal, yttrium (Y), and scandium (Sc) in an amount less than about 0.1 wt %.

11. The air conditioner of claim 8, wherein the second aluminum alloy comprises an alloy composition of Al-xMn-yMg-zZn, and wherein x, y, and z satisfy: $-90 \leq 52x - 11.6y - 87z \leq 70$, and $x \leq 2$, $y \leq 0.3$, and $z \leq 2.7$.

12. The air conditioner of claim 11, wherein each of the heat-exchanger fins comprises less than about 0.7 wt % of Mn and less than about 1 wt % of each of Mg and Zn.

13. The air conditioner of claim 8, wherein the third aluminum alloy comprises an alloy composition of Al-mSi-nZn, and wherein m and n satisfy: $-110 \leq 2.7m - 87n \leq 40$, and $m \leq 10$ and $n \leq 1.3$.

14. The air conditioner of claim 13, wherein the filler comprises less than about 1.3 wt % of Zn.

15. A tube comprising an aluminum alloy comprising an alloy composition of Al-aMn-bMg-cZn-dCr-eGa, wherein the tube has a corrosion potential of −745 mV to −695 mV, and wherein a, b, c, d, and e satisfy: $70 \leq 52a - 11.6b - 87c + 0.15d - 0.37e \leq -70$, and $0.25 \leq a \leq 1.2$, $0.05 \leq b \leq 1.2$, $0.05 \leq c \leq 1.0$, $d \leq 0.2$, and $e \leq 0.1$.

* * * * *